US008162782B2

(12) United States Patent
Chen

(10) Patent No.: US 8,162,782 B2
(45) Date of Patent: Apr. 24, 2012

(54) PALM PAD DEVICE FOR BASKETBALL TRAINING AND BASKETBALL TRAINING SYSTEM

(75) Inventor: Chung-Chiang Chen, Hsinchu (TW)

(73) Assignee: National Chiao Tung University, Hsinchu (TW)

( * ) Notice: Subject to any disclaimer, the term of this patent is extended or adjusted under 35 U.S.C. 154(b) by 0 days.

(21) Appl. No.: 12/755,646

(22) Filed: Apr. 7, 2010

(65) Prior Publication Data

US 2011/0130227 A1 Jun. 2, 2011

(30) Foreign Application Priority Data

Nov. 27, 2009 (TW) ..... 98140490 A

(51) Int. Cl.
*A63B 69/38* (2006.01)
*A63B 69/00* (2006.01)
*A61B 19/00* (2006.01)

(52) U.S. Cl. ..... 473/450; 473/422; 473/458

(58) Field of Classification Search ..... 473/422, 473/450, 458, 464, 480, 59–61, 201, 205, 473/256, 212; 463/25; 434/247, 248; 2/20, 2/161.6, 159, 421, 161.1, 163, 16; 602/20–22; 128/869, 878, 879; 119/14.22; D21/701, D21/781; D29/113, 123
See application file for complete search history.

(56) References Cited

U.S. PATENT DOCUMENTS 2,845,628 A * 8/1958 Dell ..... 2/20
3,413,000 A * 11/1968 Alkonis ..... 473/61
3,496,573 A * 2/1970 Pope et al. ..... 2/161.6
3,501,773 A * 3/1970 Stansberry et al. ..... 2/159
3,564,613 A * 2/1971 Fowler ..... 2/159
3,581,312 A * 6/1971 Nickels ..... 2/159
3,640,532 A * 2/1972 Bauer ..... 473/450
3,707,730 A * 1/1973 Slider ..... 2/161.1
4,496,151 A * 1/1985 Tureaud ..... 473/59
4,617,684 A * 10/1986 Green et al. ..... 2/20
4,805,905 A 2/1989 Haub
4,858,920 A * 8/1989 Best ..... 473/480
5,149,085 A * 9/1992 Sanchez ..... 473/450
5,236,190 A * 8/1993 Moss ..... 473/450
5,427,577 A * 6/1995 Picchietti et al. ..... 473/59
5,636,381 A * 6/1997 Brogden ..... 2/161.1
5,826,281 A * 10/1998 Rush, III ..... 2/421
5,833,233 A * 11/1998 Strug ..... 473/450
6,223,353 B1 * 5/2001 Lardieri, Jr. ..... 2/161.1
6,244,271 B1 * 6/2001 Turner et al. ..... 128/869
D479,864 S * 9/2003 Maham ..... D21/662
6,712,722 B1 * 3/2004 Mosley ..... 473/450
(Continued)

*Primary Examiner* — Mitra Aryanpour
(74) *Attorney, Agent, or Firm* — Peter F. Corless; Steven M. Jensen; Edwards Wildman Palmer LLP

(57) ABSTRACT

A palm pad device, for use as a training device and to be fastened to the palm of a user, includes a segregate pad having a size-adjustable elastic pad and a fastening member for fastening the segregate pad onto the palm. The palm pad device further includes a sensing recorder disposed on the fastening member for sensing and recording movement data of the palm. The elastic pad includes a thickness pad and a width pad for allowing adjustments in the thickness and width of the segregate pad. A basketball training system using the palm pad device includes a basket sensor for recording the status of successful shots, a sensing recorder disposed on the palm pad device, and a central management apparatus for receiving data transmitted from the sensing recorder and the basket sensor for conducting analysis to thereby generate a corresponding feedback event.

14 Claims, 8 Drawing Sheets

U.S. PATENT DOCUMENTS

| | | | | |
|---|---|---|---|---|
| 6,991,553 | B2 * | 1/2006 | Park et al. | 473/219 |
| D585,605 | S * | 1/2009 | Kamradt | D29/113 |
| 7,544,138 | B2 * | 6/2009 | Weber et al. | 473/450 |
| 7,582,030 | B2 * | 9/2009 | LaPergola | 473/450 |
| 7,771,293 | B1 * | 8/2010 | Vann | 473/422 |
| 7,966,670 | B2 * | 6/2011 | Wilbert et al. | 2/161.1 |
| 2006/0143783 | A1 * | 7/2006 | Berman | 2/159 |
| 2006/0195968 | A1 * | 9/2006 | Powell et al. | 2/161.1 |
| 2006/0272072 | A1 | 12/2006 | Murphy | |
| 2011/0130227 | A1 * | 6/2011 | Chen | 473/450 |

* cited by examiner

PALM PAD DEVICE FOR BASKETBALL TRAINING AND BASKETBALL TRAINING SYSTEM

CROSS-REFERENCES TO RELATED APPLICATIONS

This application claims under 35 U.S.C. §119(a) the benefit of Taiwanese Application No. 98140490 filed Nov. 27, 2009 the entire contents of which is incorporated herein by reference.

BACKGROUND OF THE INVENTION

1. Field of the Invention

This invention relates to palm pad devices for basketball training and basketball training systems, and more particularly, to a palm pad device that allows itself to be fastened to the palm of a user to facilitate basketball training and a basketball training system to which the palm pad device is applied.

2. Description of Related Art

In the past, ball players are trained with their bare hands. With the progress of science and technology, more and more ball players are trained with the help of a variety of auxiliary equipment and get better training effect. For example, a package load with lead is often used by players to improve their muscles endurance, by binding the package to their legs or hands. Regarding basketball training, players need to use their wrists and fingers, but not their central palm, to control a basketball while dribbling, passing and shooting the basketball. Accordingly, various auxiliary apparatuses for basketball training came to the market. U.S. Patent Application Publication No. 2006/0272072 disclosed a basketball training glove. A palm pad element is installed on the central palm of the glove, forcing the user not to palm a basketball while dribbling, holding and shooting the basketball. However, the palm pad element of the basketball training glove has a constant shape and is not adjustable. In other words, such a constant-sized basketball training glove cannot provide the best training effect to users because their hands have different sizes.

U.S. Pat. No. 4,805,905 disclosed a basketball training device, to train and correct twisting level of the wrist of shooting arm of a user. However, the basketball training device is installed on the arm near the wrist, and provides the user with shooting practice only, without including other practices such as passing and dribbling. The basketball training device is dull and impractical.

Therefore, how to find an auxiliary device for basketball training in many aspects, such as facilitating the practice of dribbling and shooting movements, recording and analyzing movement data of the hands and palms of the user, and allowing the user to know his shooting flaws and thus make a real-time modification, has become one of the most urgent issues in the art.

SUMMARY OF THE INVENTION

In view of the above-mentioned problems in the prior art, the present invention provides a palm pad device for basketball training and a basketball training system. The palm pad device helps a user in practicing basketball practice, and may cooperate with the basketball training system to provide corresponding feedback event to the user.

The present invention provides a palm pad device be fastened to a palm of a user for basketball training, comprising a padding member having a size-adjustable elastic pad, and a fastening member engaged with the padding member for fastening the padding member to the palm of the user.

In an embodiment, the palm pad device of the present invention further includes a sensing recorder installed on the fastening member for sensing and recording movement data of the palm.

In another embodiment, the above sensing recorder includes a displaying unit for displaying the movement data of the palm.

In yet another embodiment, the sensing recorder further includes a transmitting unit for wiredly or wirelessly transmitting the sensed or recorded movement data to a recording apparatus.

In yet another embodiment, the sensing recorder further includes a speaking unit for generating corresponding sounds according to the movement data.

In yet another embodiment, the elastic pad further includes a thickness pad for adjusting the thickness of the padding member, and a width pad for adjusting the width of the padding member, wherein the thickness pad and the width pad have an inflatable structure.

In another variant embodiment, the padding member has a buffer gap for providing a compression buffer for the padding member when grasped, and the fastening member has an elastic gap for providing a compression buffer for the fastening member when grasped.

The present invention also provides a basketball training system to which the above-mentioned palm pad device is applied, including: a basket sensor for recording a status of successful shots of a user; a sensing recorder installed on the palm pad device for sensing and recording movement data of a palm of the user; and a central management apparatus for receiving and analyzing the status of successful shots transmitted from the basket sensor and the movement data transmitted from the sensing recorder to generate a corresponding feedback event.

Compared with the prior art, the palm pad device for basketball training according to the present invention includes a padding member to help a user to practice playing basketball with his fingers. The padding member has a thickness pad and a width pad for adjusting the thickness and the width of the padding member, respectively. Therefore, each user may adjust the padding member in accordance with his palm size, to improve practicing effect. Further, the palm pad device includes a sensing recorder. The sensing recorder senses palm movement status of the user, and provides palm movement status records, data display and real-time sounds with a variety functions installed thereon. The basketball training system combines the above-mentioned palm pad device with a basket sensor, a sensing recorder and a central management, thereby to analyze a status of successful shots of the user and provide more efficient training information to the user.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

Figure 1:
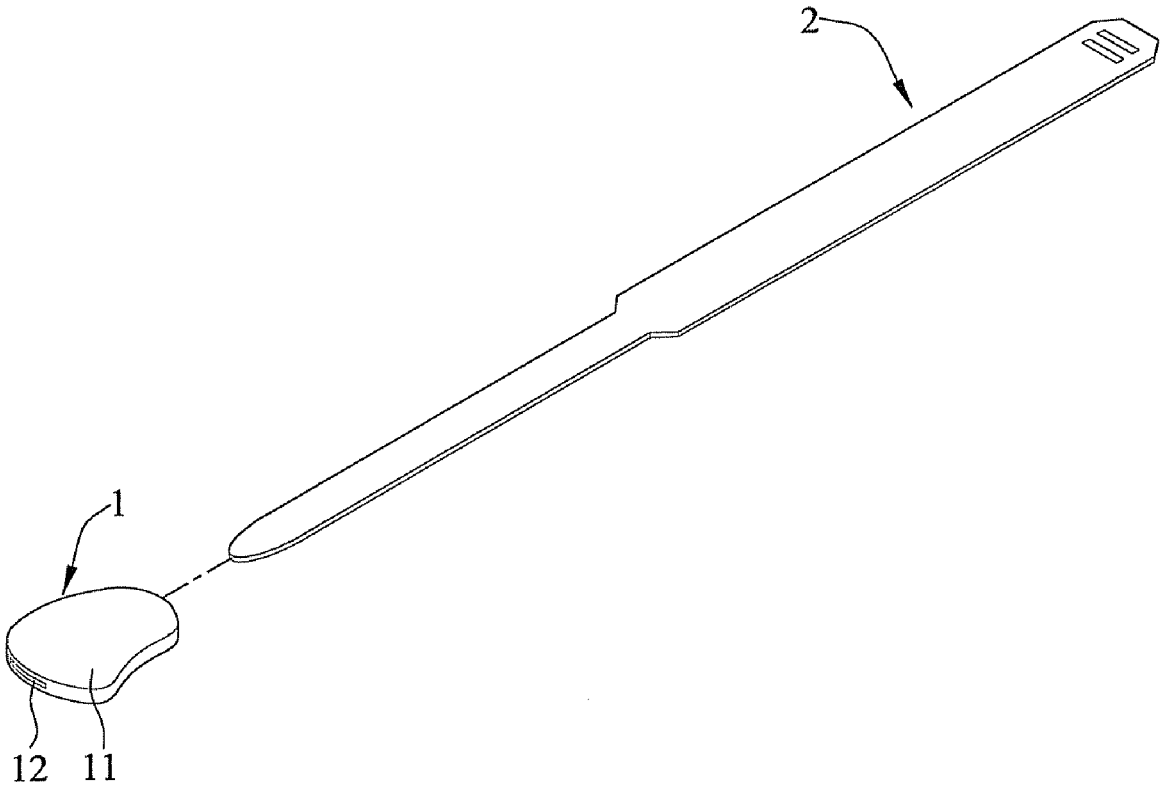
FIG. 1 is a 3-D diagram of a palm pad device for basketball training according to the present invention.

FIG. 1 is a 3-D diagram of an embodiment of a palm pad device for basketball training according to the present invention. As shown in FIG. 1, the present invention provides a palm pad device for basketball training, which is to be fastened to a palm of a user to facilitate basketball training and comprises a padding member 1 and a fastening member 2. The padding member 1 has a size-adjustable elastic pad 11. In other words, the padding member 1, as a whole, is a size-adjustable elastic or soft pad body. The fastening member 2 is engaged with the padding member 1 for fastening the padding member 1 to the palm of the user. Through holes 12 are installed on two sides of the padding member 1 for the fastening member 2 to pass therethrough and be engaged with the padding member 1 to form the palm pad device.

In use, the padding member 1 is placed at the center of the palm of the user, and may be in the shape of a ball, mushroom or cuboid. The embodiment is fabricated in accordance with the shape of the center of the palm, the central concave portion of the palm and a part of the palm between the thumb and the index finger, so as to form a pad body structure that is suitable to be placed at the center of the palm. The fastening member 2 is a strip and has a cross section in the shape of a rectangle, a circle or an ellipse. The fastening member 2 fastens the padding member 1 to the palm of the user by passing itself through the through holes 12 of the padding member 1. Such a design allows the user to replace the fastening member 2 according to his demands. However, in another embodiments the fastening member 2 may be engaged with the padding member 1 by adhesive, tenons or other ways. In an embodiment, the padding member 1 and the fastening member 2 are fabricated from rubber, plastic, resin or PU.

In the use of the palm pad device, the elastic pad 11 prevents the palm of the user from palming a basketball directly. Accordingly, the user, when practicing dribbling or shooting, may control the basketball with his fingers only, so as to improve the smoothness of dribbling movement and increase shooting percentage.

Figure 2A:
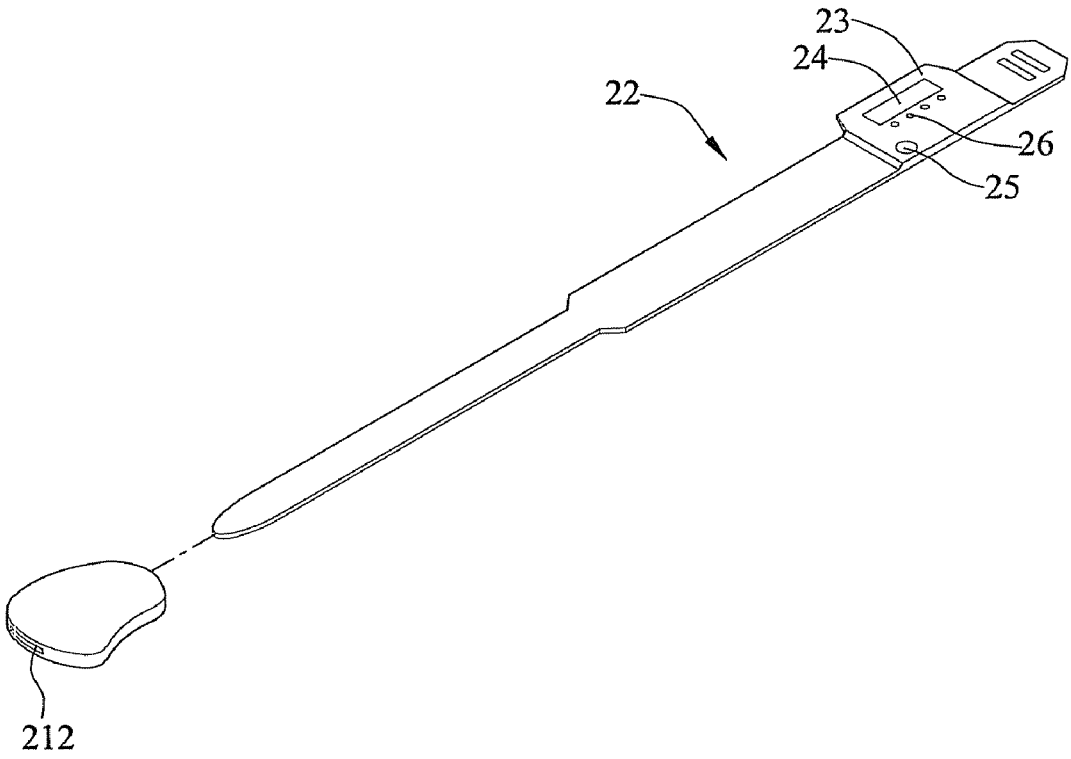
FIG. 2A is a 3-D diagram of a sensing recorder of another embodiment of a palm pad device for basketball training according to the present invention.

FIG. 2A is a 3-D diagram of a sensing recorder of another embodiment of a palm pad device for basketball training according to the present invention. As shown in FIG. 2A, the palm pad device of the embodiment further comprises a sensing recorder 23 installed on the fastening member 22 for sensing and recording movement data of the palm. The sensing recorder 23 senses and records the movement data of the palm while the palm pad device is installed on the palm of the user. The sensing recorder 23 has a digital display screen 24 for displaying information, a speaker 25 for playing sounds, and an operation button 26. Through the above elements, the sensing recorder 23 may perform various functions to facilitate basketball training of the user.

Figure 2B:
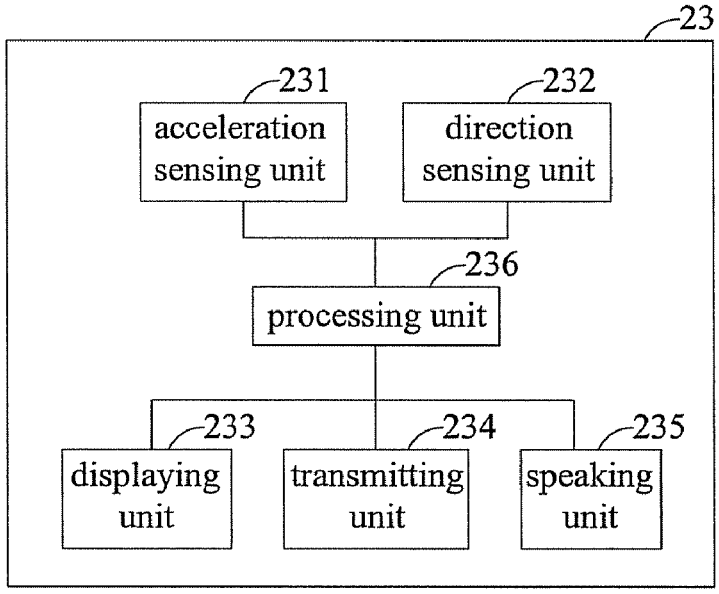
FIG. 2B is a system block diagram of a sensing recorder of a palm pad device for basketball training according to the present invention.

FIG. 2B is a system block diagram of a sensing recorder of a palm pad device for basketball training according to the present invention. As shown in FIG. 2B, the sensing recorder 23 further comprises an acceleration sensing unit 231 and/or a direction sensing unit 232. The acceleration sensing unit 231 senses movement track and turning speed of the palm. In other words, the acceleration sensing unit 231 senses and records the movement track and turning speed of the palm when the user is shooting. The direction sensing unit 232 senses an angle of the palm relative to the ground to obtain an movement angle of the palm when the user is shooting. Based on the above recorded data, the user may get to know the gesture of his palm while his shooting, and adjust the action of the palm, so as to increase shooting percentage and improve the smoothness of dribbling movement.

The sensing recorder 23 further comprises a displaying unit 233, a transmitting unit 234, and a speaking unit 235. The displaying unit 233 displays the movement data of the palm, as the digital display screen shown in FIG. 2A does. The transmitting unit 234 wiredly or wirelessly transmits the sensed or recorded movement data to a recording apparatus. In other words, the sensed data can not only be recorded in the sensing recorder 23, but also be wiredly or wirelessly transmitted via the transmitting unit 234 to other data processing apparatuses, for statistics of the data recorded or view for personnel on the spot. The speaking unit 235 generates corresponding sounds according to the movement data, as the speaker 25 shown in FIG. 2A does. When the palm of the user is moving (e.g., dribbling or shooting), the speaking unit 235 plays corresponding sounds simultaneously, such as cheer sounds or sounds reminding the user of adjusting his movement, so as to increase the interest of basketball training. All the data of the sensing recorder 23 are processed by a processing unit 236. The processing unit 236 analyzes, compares and records the sensed movement information of the palm, and generates a corresponding feedback event, such as the aforementioned playing sounds, displaying statistic data or transmitting gesture adjustment messages to the palm pad device applied to the.

Figure 3:
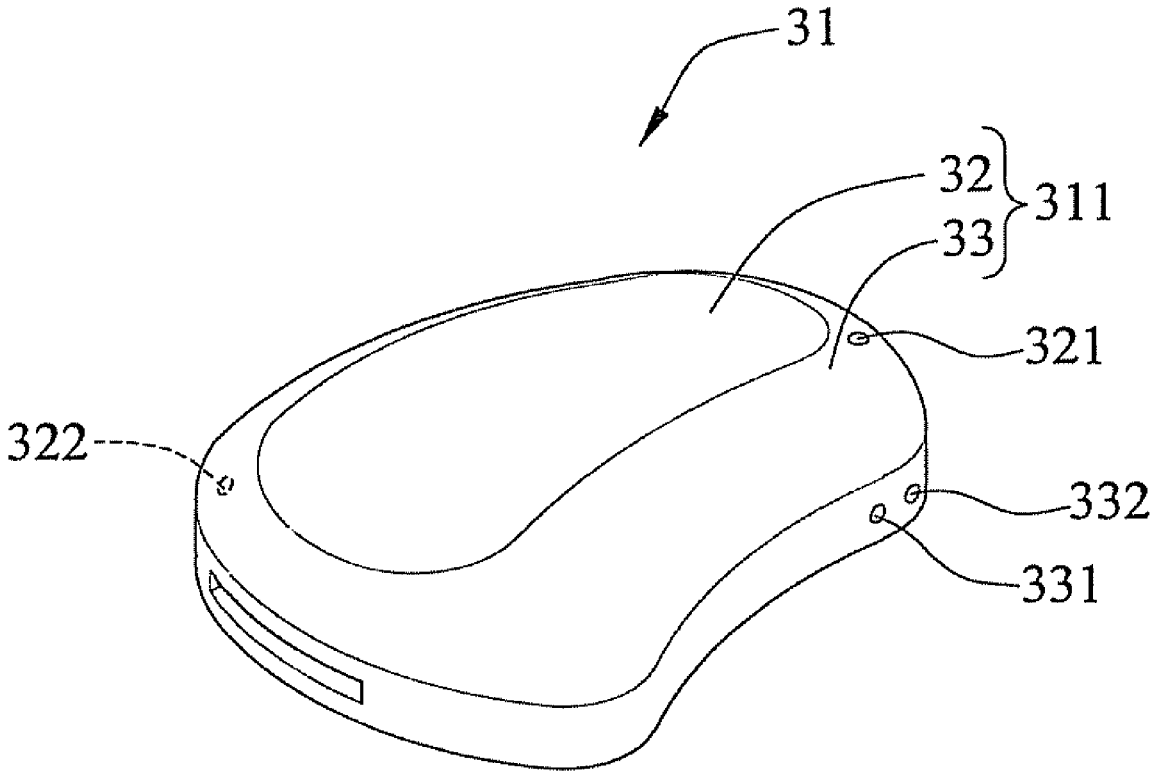
FIG. 3 is a 3-D diagram of a variant embodiment of a padding member of a palm pad device for basketball training according to the present invention.

FIG. 3 is a 3-D diagram of a variant embodiment of a padding member of a palm pad device for basketball training according to the present invention. As shown in FIG. 3, the elastic pad 311 further comprises a thickness pad 32 for adjusting the thickness of the padding member 31 and a width pad 33 for adjusting the width of the padding member 31. The thickness pad 32 and the width pad 33 has an inflation structure, allowing the user to adjust the size of the padding member 31 to suit for the palm of different users.

As shown, the thickness pad 32 has an air inlet hole 321, and the width pad 33 also has an air inlet hole 331. The user is allowed to insert inflation tubes in the two air inlet holes and input air, so as to adjust the thickness and width of the elastic pad 311. The thickness pad 32 and width pad 33 further comprise air outlet holes 322 and 332, respectively, for expelling or adjusting the amount of the air. Accordingly, the user may adjust the amount of air in the elastic pad 311 easily and store it up (expelling the air to reduce the size of the elastic pad 311).

In another embodiment, the thickness pad 32 and width pad 33 has a pump inflation structure. Accordingly, the user is allowed to input air into the elastic pad 311 in a pump inflation way, thereby omitting the use of the above inflation tubes, and greatly improving the use convenience of the palm pad device.

Figure 4A:
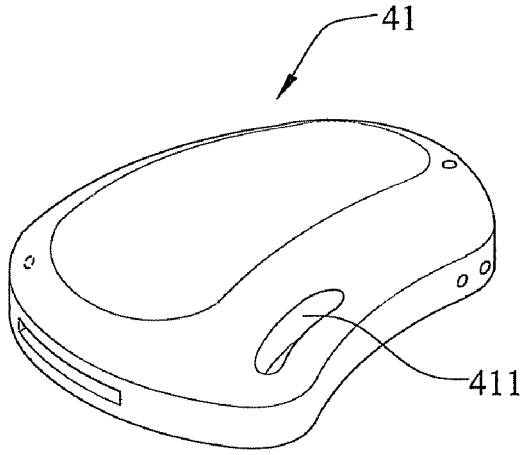
FIG. 4A is a 3-D diagram of an embodiment of a padding member of a palm pad device for basketball training according to the present invention.

FIG. 4A is a 3-D diagram of an embodiment of a padding member of a palm pad device for basketball training according to the present invention. As shown in FIG. 4A, a padding member 41 has a buffer gap 411 for providing a compression buffer for the padding member 41 when grasped. In details, in order to prevent the user from feeling uncomfortable with his palm when the padding member 41 is placed at the center of the palm and is compressed while the palm is grasping the padding member 41, the padding member 41 has the buffer gap 411 installed, to ease the uncomfortable felling. The present invention does not limit the number of the buffer gap 411 and the place where the buffer gap 411 is installed.

Figure 4B:
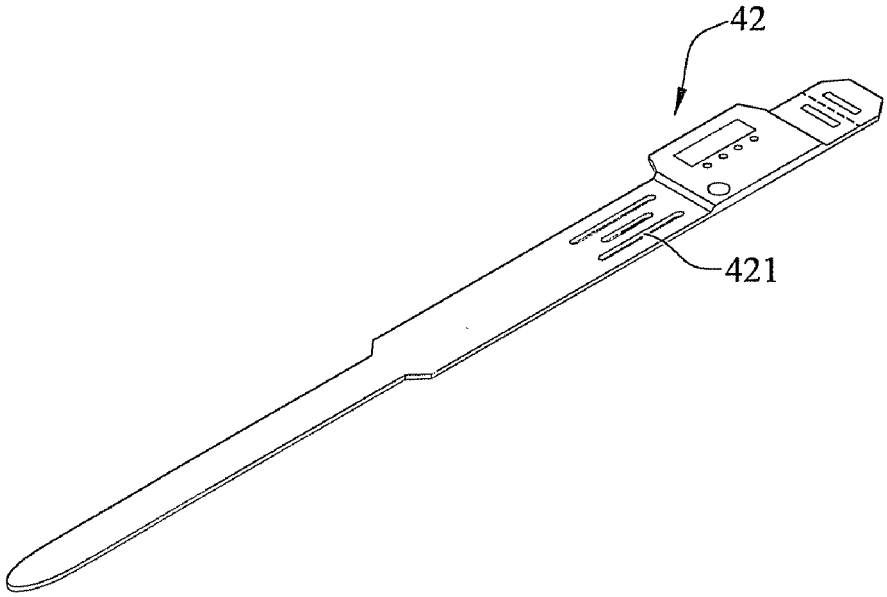
FIG. 4B is a 3-D diagram of an embodiment of a fastening member of a palm pad device for basketball training according to the present invention.

FIG. 4B is a 3-D diagram of an embodiment of a fastening member of a palm pad device for basketball training according to the present invention. As shown in FIG. 4B, a fastening member 42 has an elastic gap 421 for providing a compression buffer for the fastening member 42 when grasped. Since the user may feel uncomfortable with his palm when the fastening member 42 is put on the palm and a part of the palm between the thumb and the index finger is compressed when the palm is waving or grasping, the elastic gap 421 may serve as an elastic space of the compression buffer when the user is grasping his palm. The present invention does not limit the number of the elastic gap 421 and the place where the buffer gap 411 is installed.

Figure 5:
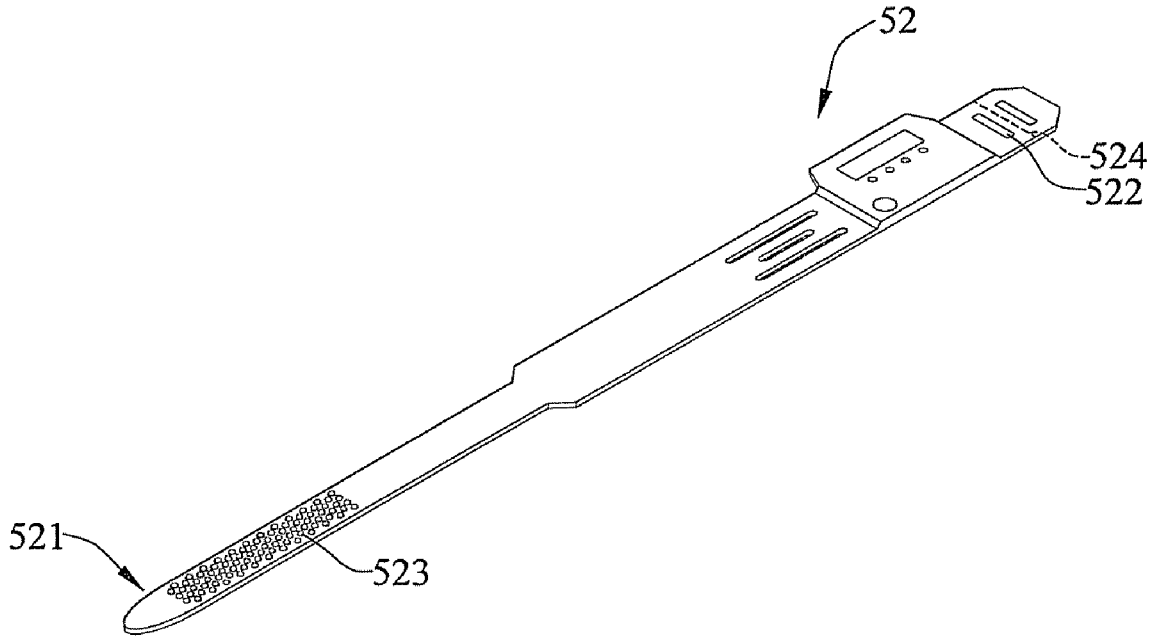
FIG. 5 is a 3-D diagram of an embodiment of a fastening member of a palm pad device for basketball training according to the present invention.

FIG. 5 is a 3-D diagram of an embodiment of a fastening member of a palm pad device for basketball training according to the present invention. As shown in FIG. 5, a fastening member 52 has a buckling portion 521 for use in fastening, a corresponding buckling hole 522, and a skidproof portion 523 having a skidproof function and installed on the buckling portion 521. The fastening member 52 performs fastening by passing the buckling portion 521 through the buckling hole 522 and provides better fastening of the fastening member 52 through the friction and engagement of a buckling folded line 524 at the buckling portion 521 to the skidproof portion 523.

In another embodiment, the fastening member 52 has an adhering portion and an adhering base, allowing the fastening member 52 to be fastened to the palm of the user through the engagement of the adhering portion with the adhering base. For example, the fastening member 52 is fastened by the use of a VELCRO (hook and loop fasteners).

Figure 6A:
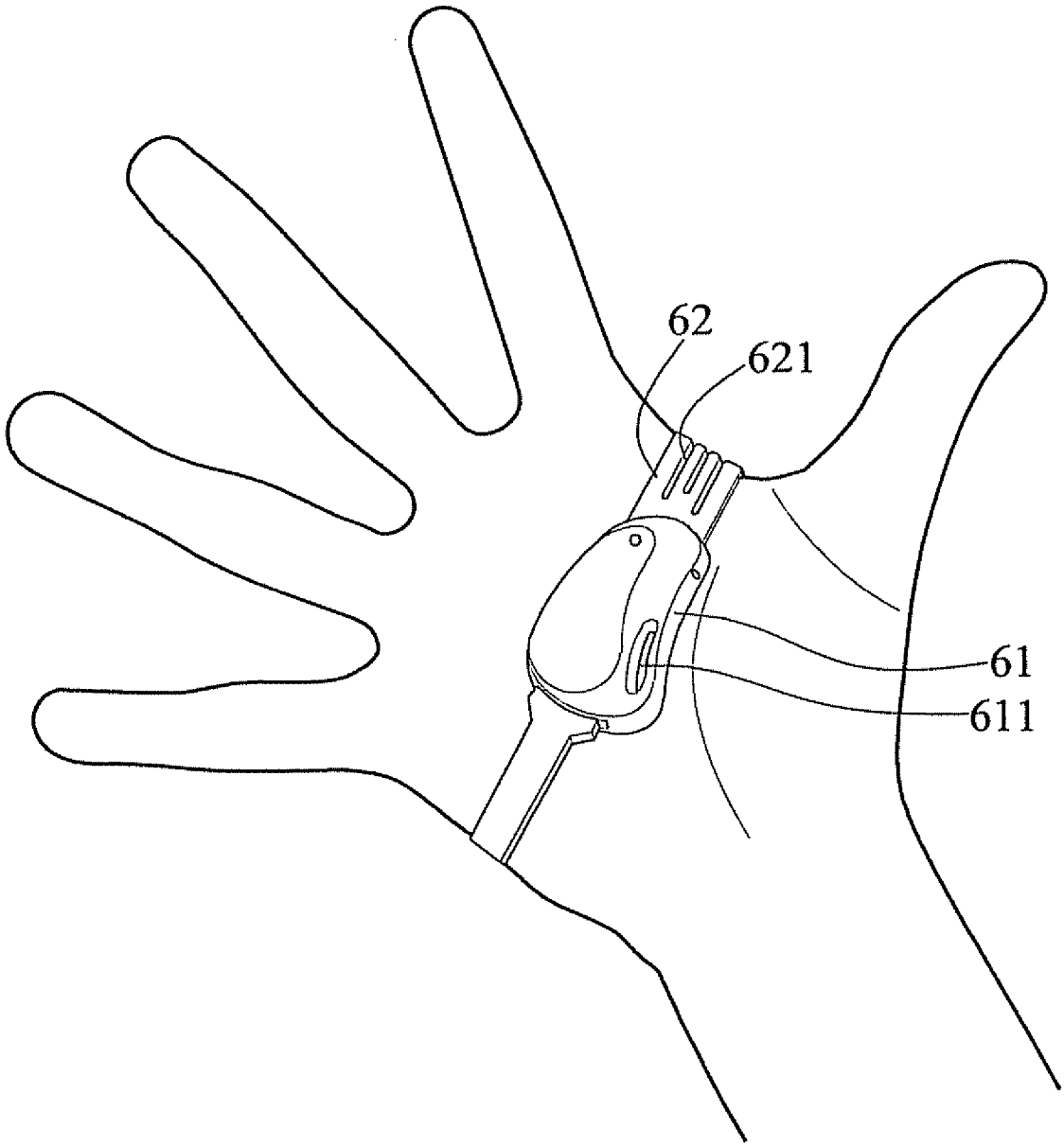
FIGS. 6A and 6B show how to use a palm pad device for basketball training according to the present invention.

FIG. 6A shows how to use a palm pad device for basketball training according to the present invention. As shown in FIG. 6A, a padding member 61 is fastened to the palm of the user with a fastening member 62, and the padding member 61 is fabricated according to the shape of the palm and has an inflation structure that has adjustable thickness and width. The padding member 61 has a buffer gap 611, allowing the user to grasp elastically. The fastening member 62 has an elastic gap 621 installed at a position corresponding to a part of the palm between the thumb and the index finger, to provide a compression buffering effect when the palm is grasping.

Figure 6B:
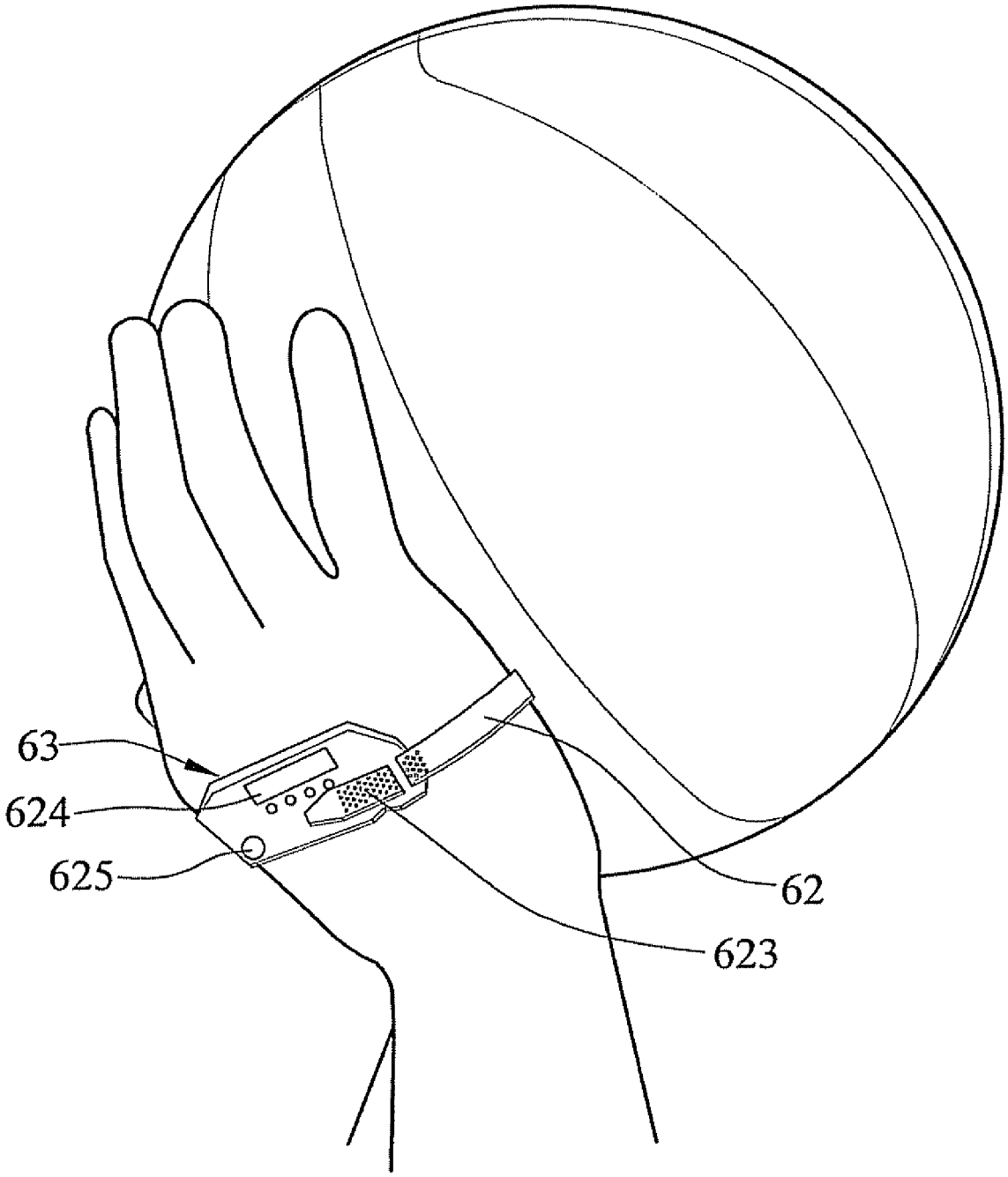

FIG. 6B shows how to use a palm pad device for basketball training according to the present invention. FIG. 6B shows a state that a sensing recorder 63 and the fastening member 62 are placed at the back of the palm. A skidproof portion 623 is installed at the fastening member 62 to provide engagement and fastening. The sensing recorder 63 has a digital display screen 624 for displaying data or statues, and a speaker 625 for playing sounds, thereby displaying or providing corresponding information to the user.

The fastening member of the palm pad device of the present invention is not limited to have a certain shape or fastening way. The fastening member may be in the shape of a ring, a glove or a C-clamp. Since the padding member and the fastening member are designed to be detachable from each other, the fastening member may be fabricated according to the user's demand, as long as it does not affect the operation of the padding member.

In addition to shooting training, the palm pad device of the present invention may also provide passing and dribbling training when the palm pad device is put on the palm, and is far superior to the conventional shooting training device or a simple central palm pad body structure.

Figure 7:
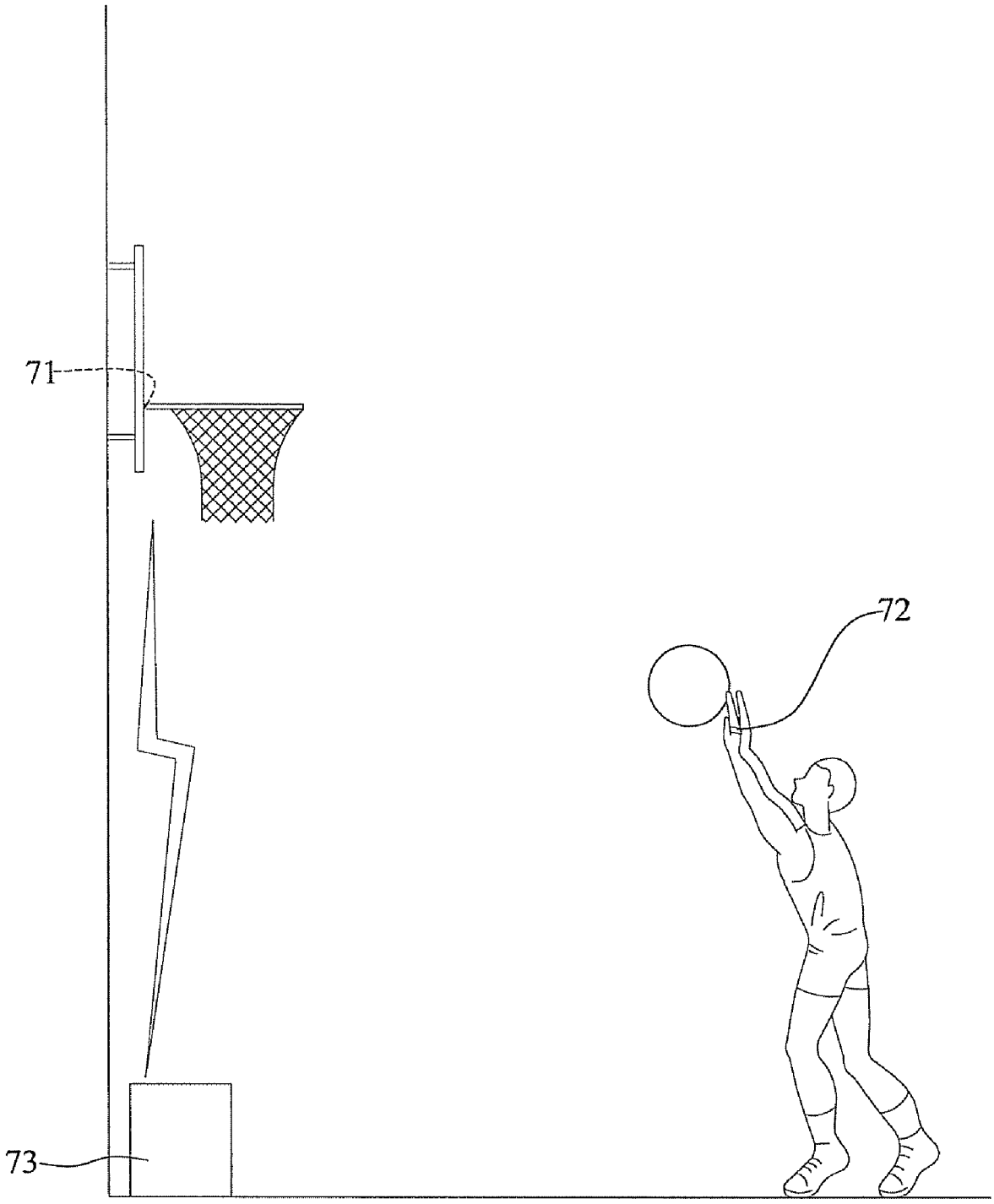
FIG. 7 is a 3-D diagram illustrating the use of an embodiment of a basketball training system according to the present invention.

FIG. 7 is a 3-D diagram illustrating the use of an embodiment of a basketball training system according to the present invention. As shown in FIG. 7, the basketball training system comprises a basket sensor 71, a sensing recorder 72 and a central management apparatus 73. The basket sensor 71 may be mounted to a basket of a basketball stand, for recording a status of successful shots of a user. The sensing recorder 72 is installed on the above-mentioned palm pad device, for sensing and recording movement data of a palm of the user. The central management apparatus 72 receives and analyzes the status of successful shots transmitted from the basket sensor 71 and the movement data transmitted from the sensing recorder 72 to generate a corresponding feedback event. Simply speaking, the basketball training system records shooting training status of the user with the sensing recorder 72 and the basket sensor 71, and transmits it to the central management apparatus 73 off the court for data statistics and analysis, thereby providing the user with useful shooting data and generating a corresponding feedback event. The feedback event includes playing sounds, displaying statistic data or transmitting gesture adjustment messages to the palm pad device, so as to feedback information in a real-time manner and provide more efficient training effect. Further, the basket sensor 71 may sense the number, angle or orientation of baskets, and the central management apparatus 73 has data statistics, analysis and transmittance functions. Further description is omitted hereby.

In sum, the present invention provides a palm pad device for basketball training. Through the use of a size-adjustable padding member that is to be fastened to a palm of a user, the palm of the user may be prevented from palming a basketball directly. Through the adjustment of the thickness pad and width pad of the padding member, the palm pad device can be applied to the palm of different users. Further, the palm pad device has a sensing recorder that senses and records movement data of the palm. In other words, the sensing recorder records the palm operation status of the user, for the provision to the user as a training reference. The present invention further provides a basketball training system to which the above-mentioned palm pad device is applied. The basketball training system applies the palm pad device to shooting practice, thereby analyzing the information sensed by the basket sensor and the sensing recorder of the palm pad device and providing real-time feedback information to the user. Therefore, the shooting practice effect is greatly improved.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. A palm pad device to be fastened to a palm of a user for basketball training, comprising:

a padding member having a size-adjustable elastic pad; and a fastening member engaged with the padding member for fastening the padding member to the palm of the user, wherein the elastic pad comprises a thickness pad for adjusting the thickness of the padding member, and a width pad for adjusting the width of the padding member.

2. The palm pad device of claim 1, further comprising a sensing recorder installed on the fastening member for sensing and recording movement data of the palm.

3. The palm pad device of claim 2, wherein the sensing recorder comprises an acceleration sensing unit for sensing movement track and turning speed of the palm.

4. The palm pad device of claim 2, wherein the sensing recorder comprises a direction sensing unit for sensing an angle of the palm relative to the ground.

5. The palm pad device of claim 2, wherein the sensing recorder comprises a displaying unit for displaying the movement data of the palm.

6. The palm pad device of claim 2, wherein the sensing recorder comprises a transmitting unit for wiredly or wirelessly transmitting the sensed or recorded movement data to a recording apparatus.

7. The palm pad device of claim 2, wherein the sensing recorder comprises a speaking unit for generating corresponding sounds according to the movement data.

8. The palm pad device of claim 1, wherein the thickness pad or the width pad has an inflatable structure.

9. The palm pad device of claim 8, wherein the thickness pad and the width pad have an air inlet hole for air to be input therethrough so as to adjust the size of the elastic pad.

10. The palm pad device of claim 8, wherein the inflation structure of the thickness pad and the width pad is a pump inflation structure for air to be input therein to adjust the size of the elastic pad.

11. The palm pad device of claim 1, wherein the padding member has a through hole for the fastening member to pass therethrough and be engaged therewith.

12. The palm pad device of claim 1, wherein the fastening member has a buckling portion for use in fastening, a corresponding buckling hole, and a skidproof portion having a skidproof function and installed on the buckling portion.

13. The palm pad device of claim 1, wherein the fastening member has an adhering portion and an adhering base, allowing the padding member to be fastened to the palm of the user through the engagement of the adhering portion with the adhering base.

14. The palm pad device of claim 1, wherein the fastening member is in the shape of a ring, a glove or a C-clamp, for fastening the padding member to the palm of the user.

* * * * *